US006486758B1

(12) United States Patent
Olszewski et al.

(10) Patent No.: US 6,486,758 B1
(45) Date of Patent: Nov. 26, 2002

(54) SHOCK-RESISTANT CIRCUIT BREAKER WITH INERTIA LOCK

(75) Inventors: David Michael Olszewski, McKees Rocks, PA (US); David Curtis Turner, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 51 days.

(21) Appl. No.: 09/717,871

(22) Filed: Nov. 21, 2000

(51) Int. Cl.[7] ..... H01H 75/00; H01H 77/00

(52) U.S. Cl. ..... 335/6; 335/21; 335/46; 335/157; 335/158; 335/172; 335/176

(58) Field of Search ..... 335/6, 21, 46, 335/167–176, 157, 158

(56) References Cited

U.S. PATENT DOCUMENTS 6,252,477 B1 * 6/2001 Endo et al. ..... 200/541

* cited by examiner

*Primary Examiner*—Ramon M. Barrera
(74) *Attorney, Agent, or Firm*—Martin J. Moran

(57) ABSTRACT

A shock-resistant solenoid assembly includes a trip solenoid and an inertia lock, the inertia lock being operable to resist unintended engagement of a core of the trip solenoid with a trip plunger of a trip unit of a circuit breaker. The core is movable along a tripping path between a retracted position and an extended position, with the core engaging the trip plunger in the extended position. The inertia lock includes an inertia member and a latch. In response to shock loading, the inertia member interposes the latch into the tripping path to engage the core and resist the core from operatively engaging the tripping plunger under inappropriate conditions. The Abstract shall not be used for interpreting the scope of the Claims.

2 Claims, 1 Drawing Sheet

SHOCK-RESISTANT CIRCUIT BREAKER WITH INERTIA LOCK

BACKGROUND OF THE INVENTION

1. Field of the Invention

The present invention relates generally to circuit breakers and, more particularly, to a shock-resistant solenoid assembly with an inertia lock for use in a circuit breaker.

2. Description of the Related Art

Numerous types of circuit breakers are known and understood in the relevant art. Among the purposes for which circuit breakers are provided is to interrupt current on demand or under certain defined circumstances. In this regard, multi-phase circuit breakers typically include a trip unit that can simultaneously open the contacts of all of the phases to interrupt electrical current. The trip unit typically includes a latch mechanism that rotates a crossbar to pivot movable contacts away from stationary contacts on demand.

While the latch mechanism is typically operated automatically during specified overcurrent and under-voltage conditions, it is often desirable to additionally provide a mechanical trip plunger on the trip unit that can operate the latch mechanism to permit the circuit breaker to be tripped manually as needed. A solenoid or shunt is typically provided to selectively engage the trip plunger to operate the latch mechanism.

While such tripping solenoids operate reliably under many conditions, circuit breaker trip mechanisms employing such tripping solenoids are often subject to inadvertent tripping during shock loading of the circuit breaker. As is known in the relevant art, a solenoid includes a core that is axially-movable with respect to the solenoid housing. During shock loading of the circuit breaker, the core of the tripping solenoid can be induced to move with respect to the solenoid housing, which can result in the core engaging the trip plunger to inappropriately trip the circuit breaker, even though the solenoid is in a deenergized condition. Such inappropriate tripping of a circuit breaker is to be particularly avoided in critical applications in which loss of power would create an unsafe or harmful condition. It is thus desired to provide a circuit breaker solenoid assembly or shunt trip apparatus that is resistant to shock loading yet is capable of engaging on command the trip plunger of a circuit breaker trip unit.

SUMMARY OF THE INVENTION

In accordance with the invention, a shock-resistant solenoid assembly includes a trip solenoid and an inertia lock, with the inertia lock being operable to resist unintended engagement of a core of the trip solenoid with a trip plunger of a trip unit of a circuit breaker. The core is movable along a tripping path between a retracted position and an extended position, with the core engaging the trip plunger in the extended position. The inertia lock includes an inertia member and a latch. In response to shock loading, the inertia member interposes the latch into the tripping path to engage the core and resist the core from operatively engaging the tripping plunger under inappropriate conditions.

In view of the foregoing, an objective of the present invention is to provide a solenoid assembly that is shock-resistant.

Another objective of the present invention is to provide a solenoid assembly that includes an inertia lock.

Another objective of the present invention is to provide a solenoid assembly that can selectively engage a trip plunger of a trip unit to trip a circuit breaker on command, yet that is resistant to shock loading.

An aspect of the present invention is to provide a shock-resistant solenoid assembly for selectively engaging a trip plunger of a trip unit of a circuit breaker and for resisting inappropriate engagement of the trip plunger in response to a shock load, the general nature of which can be stated as including a trip solenoid having a core movable along a tripping path between a retracted position and an extended position, in which the core in the extended position is engaged with the trip plunger, and an inertia lock having an inertia member operatively connected with a latch, the latch being disposed on a mount and being actuatable by the inertia member in response to the shock load to engage the core to restrain movement of the core to the extended position.

Another aspect of the present invention is to provide a shock-resistant solenoid assembly in which the latch is movable between a rest position and an activated position, in which the latch, in the activated position, engages the core. The latch is biased to the rest position by a first biasing device, and the latch in the rest position is outside the tripping path.

Another aspect of the present invention is to provide a shock-resistant solenoid assembly in which the latch is pivotably mounted on the mount.

Another aspect of the present invention is to provide a circuit breaker, the general nature of which can be stated as including a trip unit having a trip plunger, a shock-resistant solenoid assembly for selectively engaging the trip plunger and for resisting inappropriate engagement of the trip plunger in response to a shock load, the shock-resistant solenoid assembly including a trip solenoid and an inertia lock, the trip solenoid having a core movable along a tripping path between a retracted position and an extended position, in which the core in the extended position is engaged with the trip plunger, and the inertia lock having an inertia member operatively connected with a latch, the latch being disposed on a mount and being actuatable by the inertia member in response to the shock load to engage the core to restrain movement of the core to the extended position.

Still another aspect of the present invention is to provide a method of resisting a core from engaging a trip plunger of a trip unit of a circuit breaker in response to a shock load, the plunger being movable along a tripping path between a retracted position and an extended position, the plunger in the extended position engaging the trip plunger, the general nature of which can be stated as including the steps of moving an inertia lock into the tripping path in response to the shock load and contacting the core with the inertia lock at a point between the extended and retracted positions to resist the core from engaging the trip plunger.

Another aspect of the present invention is to provide a method of resisting a core from engaging a trip plunger in which the step of moving the inertia lock into the tripping path included the steps of repositioning the inertia lock from a rest position to an activated position and overcoming the bias of a biasing device that biases the inertia lock to the rest position.

Another aspect of the present invention is to provide a method of resisting a core from engaging a trip plunger in which the step of contact in the core includes the step of resisting relative movement between the core and the trip plunger in a direction toward the extended position.

BRIEF DESCRIPTION OF THE DRAWINGS

The preferred embodiment of the present invention, illustrative of the best mode in which Applicants have contemplated applying the principles of the present invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

Figure 1:
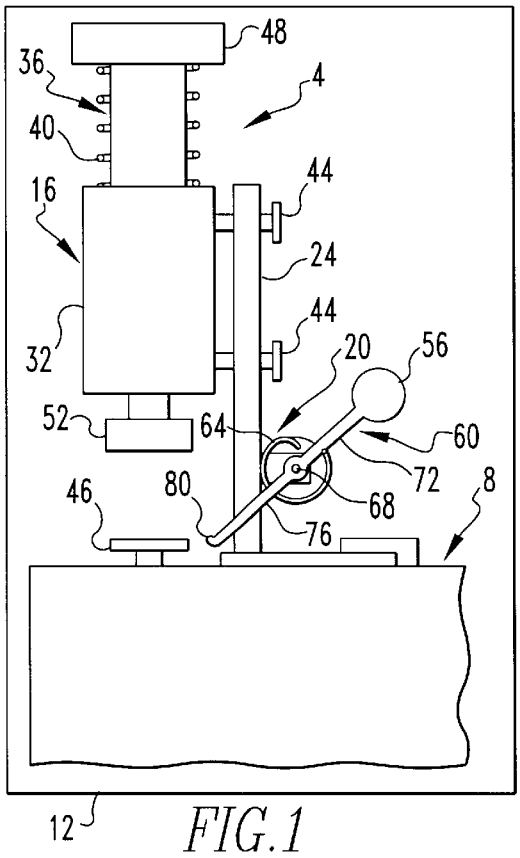
FIG. 1 is a top plan view of a shock-resistant solenoid assembly in accordance with the present invention mounted on a schematic representation of a trip unit that is mounted within a schematic representation of a circuit breaker, with a core of a solenoid being in a retracted position.
Figure 2:
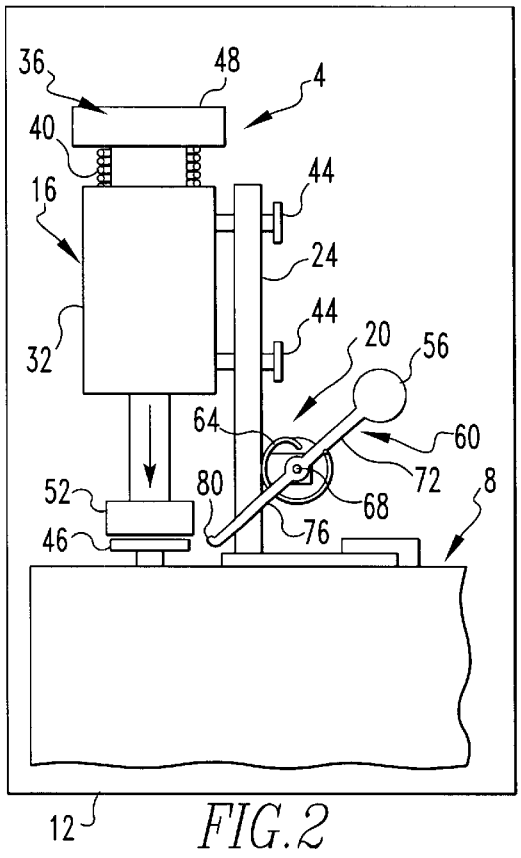
FIG. 2 is a view similar to FIG. 1, except showing the core in an extended position in operative contact with a trip plunger of the trip unit.
Figure 3:
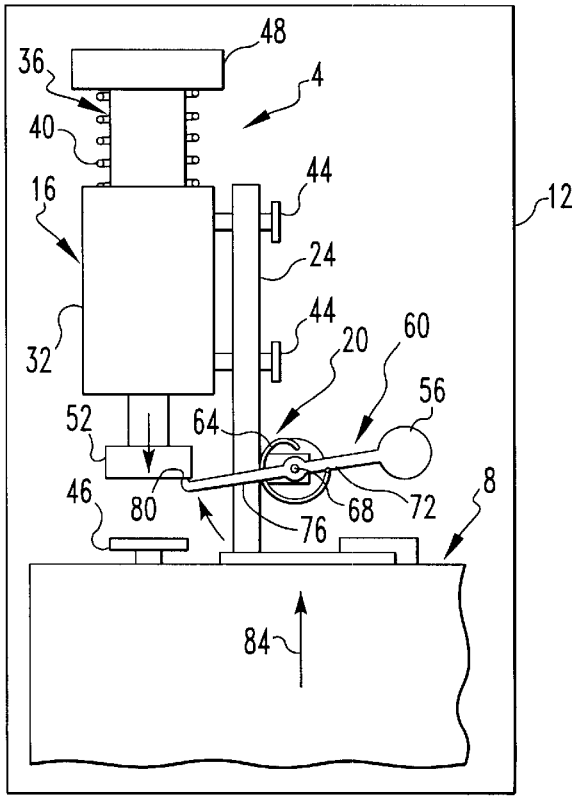
FIG. 3 is a view similar to FIG. 1, except showing an inertia lock of the solenoid assembly in contact with the core at a point between the retracted and extended positions.

A shock-resistant solenoid assembly 4 in accordance with the present invention is indicated generally in FIGS. 1–3. The solenoid assembly 4 is configured to selectively operatively engage a trip unit 8 of a circuit breaker 12 to rotate a crossbar (not shown) of the trip unit 8 or operate some other mechanism to interrupt current through the circuit breaker 12. The solenoid assembly 4 is advantageously configured to resist inappropriate or unintended engagement with the trip unit 8 during shock loading of the circuit breaker 12.

The solenoid assembly 4 includes the trip solenoid 16 and an inertia lock 20 that are disposed on a mount 24. The mount 24 is a substantially rigid structure that is securely mounted within the circuit breaker 12 either onto the circuit breaker 12, the trip unit 8, or another appropriate and substantially immovable structure on the circuit breaker 12. In other embodiments (not shown), the mount 24 may be a component of the inertia lock 20 or the trip solenoid 16.

The trip solenoid 16 includes a housing having a coil 32, a movable core 36, and a first spring 40. The coil 32 includes a plurality of wrappings as is known in the relevant art and is mounted on the mount 24 with one or more fasteners 44, although the coil 32 can be mounted on the mount 24 with any of a variety of structures or with any of a variety of known methods.

The coil 32 is formed with a bore extending therethrough, and the core 36 is movable within the bore of the coil 32 along a tripping path between a retracted position (FIG. 1) and an extended position (FIG. 2). The core 36 in the extended position operatively engages a trip plunger 46 of the trip unit 8.

The core 36 is an elongated member that is magnetically permeable in a known fashion and that includes a flared retention end 48 at a first end thereof and an actuation end 52 at a second opposite end thereof. The spring 40 is operatively interposed between the flared retention end 48 and the coil 32 and thus operates as a biasing device to bias the core 36 to the retracted position when the coil 32 is in a deenergized condition.

As is understood in the relevant art, the coil 32 can be either in the deenergized condition (in which case the core remains biased to the retracted position in the absence of shock loading) and an energized condition. The coil 32 in the energized condition magnetically causes the core 36 to overcome the bias of the first spring 40 and move to the extended position, whereby the actuation end 52 operatively engages the trip plunger 46 to trip the circuit breaker 12 (FIG. 2). In moving between the retracted and extended positions, the core 36 moves along the tripping path.

The inertia lock 20 includes an inertia member 56, a latch 60, and a second spring 64. As will be seen set form more fully below, the inertia lock 20 advantageously responds to shock loading substantially simultaneously with the core 36 and engages the core 36 at a blocking point (FIG. 3) that is intermediate the retracted and extended positions of the core 36.

In the embodiment depicted in FIGS. 1–3, the latch 60 is an elongated member that is pivotably mounted on the mount 24 with a pin 68, the pin operating as a pivot point about which the latch 60 is pivotable. The inertia member 56 is a mass that is mounted at one end of the latch 60. A bumper 80 is disposed on the latch 60 at the end opposite the inertia member 56. The latch 60 can thus be divided into an inertia portion 72 and a tripping portion 76, the inertia portion 72 being the portion of the latch 60 that extends between the pin 68 and the inertia member 56, and the tripping portion 76 being the portion of the latch 60 that extends from the pin 68 to the bumper 80.

As can be understood from FIGS. 1 and 3, the inertia lock 20 is movable between a rest position (FIG. 1) and an activated position (FIG. 3). The second spring 64 is a torsion spring that advantageously biases the inertia lock 20 to the rest position, whereby the inertia lock 20 remains in the rest position in the absence of shock loading. As indicated hereinbefore, the first spring 40 likewise biases the core 36 to the retracted position such that the core 36 remains in the retracted position in the absence of shock loading. As such, in the absence of shock loading the shock-resistant solenoid assembly 4 appears substantially as shown in FIG. 1.

Under circumstances when the circuit breaker 12 is subject to shock loading that includes a component in the direction of the shock arrow 84 shown in FIG. 3, the trip unit 8 moves relative to the core 36 and the inertia member 56. More specifically, the trip unit 8 moves in the direction of the shock arrow 84 while the core 36 and inertia member 56 have the tendency to stay substantially at rest. Such relative movement results from the core 36 and the inertia member 56 being movably mounted on the circuit breaker 12 and not being fixedly mounted thereto, and from the core 36 and inertia member both having mass and tending to stay at rest in the event of shock loading that moves the trip unit 8 in the direction of the shock arrow 84.

According to known principles, a shock load in the direction of the shock arrow 84 on the circuit breaker 12 will induce relative movement between the core 36 (which is of a first mass) and the trip unit 8, whereby the core 36 moves relative to the trip unit 8 along the tripping path from the retracted position in a direction toward the extended position, which direction is opposite the direction of the shock arrow 84. Simultaneously therewith, the shock represented by the shock arrow 84 has the same effect on the inertia member 56 (which is of a second mass), making the inertia member 56 move relatively closer to the trip unit 8, which relative movement is in a direction opposite the shock arrow 84. In this regard, since the inertia member 56 is mounted on the end of the latch 60 which is pivotably mounted on the mount 24 with the pin 68, the movement of the inertia member 56 relative to the trip unit 8 is not linearly directly toward the trip unit 8, but rather includes pivotal motion with the latch 60 as the latch 60 rotates between the rest position and the activated position. Such relative movements by the core 36 and the inertia member 56 during shock loading overcome the bias of the first and second springs 40, 64, respectively.

During such shock loading, it is understood that such motions of the core 36 and the inertia member 56 are relative to the trip unit 8, meaning that it is the trip unit 8 that moves while the core 36 and the inertia member 56 remain substantially stationary, thus resulting in the aforementioned relative movement. For the sake of simplicity, however, such relative movement will hereafter be depicted and referred to as movement of the core 36 and the inertia member 56 while the circuit breaker 12 and the trip unit 8 remain stationary.

When the inertia lock 20 is in the rest position (FIGS. 1 and 2), the latch 60 and the bumper 80 are out of the tripping path. In the absence of shock loading, therefore, the inertia lock 20 does not interfere with movement of the core 36 from the retracted to the extended position in response to the coil 32 being energized. During shock loading in the direction of the shock arrow 84, however, the inertia member 56 causes the inertia lock 20 to pivot out of the rest position, whereby the bumper 80 on the tripping portion 76 of the latch 60 is pivoted into the tripping path and into contact with the actuation end 52 of the core 36 that is similarly moving from the retracted position toward the extended position in response to the shock loading.

Such contact between the bumper 80 and the actuation end 52 occurs with the core 36 at a blocking point (FIG. 3) between the retracted and extended positions. In this regard, the inertia lock 20 is configured according to known principles such that in response to the shock load the latch 60 will have pivoted sufficiently that the bumper 80 is disposed in the tripping path prior to the core 36 reaching the area occupied by the bumper 80. In such a condition, the bumper 80 successfully engages against the leading face of the actuation end 52, as opposed to contacting the core 36 at some intermediate point thereof. Such contact between the bumper 80 and the actuation end 52 permits the motion of the inertia lock 20 from the rest position toward the activated position to counteract the undesired motion of the core 36 from the retracted position toward the extended position during shock loading, and thus restrains the core 36 from unintendedly engaging the plunger 46.

It is understood that the activated position of the inertia lock 20 refers to the position to which the inertia lock 20 ordinarily would move in response to shock loading in the absence of the core 36, and may be the same as or different than the blocking point depending on the strength of the shock and the configuration of the inertia lock 20. As such, the inertia lock 20 is configured such that a shock that would be of sufficient magnitude to otherwise cause the core 36 to unintendedly engage the plunger 46 will likewise result in the inertia lock 20 responsively pivoting to the blocking point to engage the actuation end 52 as set forth above.

As indicated hereinbefore, the core 36 is of a first mass and the inertia member 56 is of a second mass. The first and second masses are configured such that when the inertia lock 20 and the core 36 engage one another at the blocking point, the core 36 is resisted from moving beyond the blocking point toward the extended position, and rather is either retained at the blocking point by the bumper 80 or is returned toward the retracted position. In this regard, the spring constants of the first and second springs 40, 64 can be configured in conjunction with the first and second masses to achieve the desired dynamic interaction between the inertia lock 20 and the core 36 during shock loading. While it is most likely that the second mass will be greater than the first mass in most applications, the spring constants of the first and second springs 40 and 64 can be selected to operate in an environment where the second mass is equal to or less than the first mass, depending upon the specific needs of the particular application. Moreover, while it has been stated herein that the inertia member 56 is of a second mass, the second mass may, and likely will, include at least a portion of the mass of the latch 60.

During shock loading, it can be seen that as the trip unit 8 move in the direction of the shock arrow 84, the core 36 and inertia lock 20 move relative to the trip unit 8 until the core 36 and inertia lock 20 contact one another at the blocking point, after which such relative movement ceases and the core 36 and inertia lock 20 move with the trip unit 8 in the direction of the shock arrow 84 due to the reaction of the pin 68 on the latch 60. In analyzing the dynamics of the movement of the core 36 and the inertia lock 20 with regard to the trip unit 8, it is understood that when the core 36 and the inertia lock 20 contact one another at the blocking point, the moments about the pin 68 are preferred to be in equilibrium. Such equilibrium causes the aforementioned cessation of relative movement of the core 36 and inertia lock 20 and permits the motion of the trip unit 8 to be transferred through the pin 68 to the inertia lock 20 mounted on the pin and the core 36 that is in physical contact with the inertia lock. Non-equilibrium systems may, however, be employed to meet specific needs of particular applications without departing from the concept of the present invention. The spring constants of the first and second springs 40 and 64 are selected such that the desired dynamic effect is achieved in response to shock loading.

The specific configuration of the inertia member 56 and the latch 60 can be varied to achieve certain dynamic results. For instance, while the inertia member 56 is depicted from FIGS. 1–3 as being a mass mounted at one end of the latch 60, the inertia member 56 may be incorporated into the inertia portion 72 by simply configuring the inertia portion 72 to have a greater cross-section than the tripping portion 76. Additionally, while the bumper 80 is depicted in FIGS. 1–3 as being a member having a rounded face that contacts the actuation end 52 of the core 36, it is understood that the bumper 80 may be of numerous other configurations that can interact with the core 36 in different fashions to achieve desired dynamic performance with respect to the core 36.

Regardless of the specific configuration of the inertia lock 20, it can be seen that the center of gravity of the inertia lock 20 is disposed at some point within the inertia member 56 or the inertia portion 72 of the latch 60, and thus is spaced a certain distance from the pin 68 such that the pin 68 is disposed between the core 36 and the aforementioned center of gravity. By spacing the combined center of gravity of the inertia member 56 and latch 60 from the point at which the inertia lock 20 is attached to the mount 24 in a direction away from the core 36, the inertia lock 20 has a tendency to pivot from the rest position to the activated position in the presence of shock loading such that the bumper 80 experiences movement that is the opposite of movement of the core 36. Depending upon the magnitude of the shock loading, such pivoting resultingly receives the bumper 80 of the latch 60 in the tripping path to engage the actuation end 52 and to advantageously resist movement of the core 36 beyond the blocking point.

While the inertia lock 20 has been set forth hereinbefore to be of a rotational, mechanical nature, it is understood that the inertia lock 20 may be of other configurations without departing from the concept of the present invention. For instance, the inertia lock 20 may incorporate sliding or translating masses instead of a rotational mechanism.

Moreover, the inertia lock 20 may incorporate a linkage extending between the inertia member 56 and the latch 60 that converts translation of the inertia member 56 in a first direction into translation of the latch 60 in a second oblique or perpendicular direction. Still alternatively, the inertia lock 20 may include a hydraulic or pneumatic mechanism operated by the inertia member 56 to translate the latch 60 into the tripping path during shock loading. Depending upon the specific configuration of the inertia lock, therefore, the function of the mount 24 may be provided by the inertia lock 20, with the trip solenoid 16 consequently being mounted on the inertia lock.

The inertia lock 20 is thus configured to react to shock loading in substantially the same fashion as the core 36, that is, by experiencing movement relative to the trip unit 8. In responding to the shock loading, the latch 60 of the inertia lock 20 is received in the tripping path of the core 36, which causes the bumper 80 of the latch 60 to contact the core 36 at the blocking point and to restrain movement of the core 36 beyond the blocking point. In this regard, it is understood that the inertia lock 20 can be configured such that either the mass of the inertia lock 20 has the effect of countering and overcoming the mass of the core 36 at the blocking point, or such that the latch 60 is simply abuttingly received in the blocking path so as to operate as an obstruction to movement of the core 36 beyond the blocking point. An example of the latch as an obstruction would be when, for instance, the latch is capable only of movement in a direction substantially perpendicular to the tripping path.

In either case, the inertia lock 20 advantageously includes the inertia member 56 that responds to shock loading substantially contemporaneously with the core 36. As such, shock loading that could otherwise have the tendency to cause the core 36 to operatively engage the trip plunger 46 even when the coil 32 is deenergized will instead simultaneously move the inertia lock 20 from the rest position toward the activated position and to the blocking point and thus to advantageously restrain movement of the core 36 beyond the blocking point. While a particular embodiment of the present invention has been described herein, it is understood that various changes, additions, modifications, and adaptations may be made without departing from the scope of the present invention as set forth in the following claims.

What is claimed is:

1. A shock-resistant solenoid assembly for selectively engaging a trip plunger of a trip unit of a circuit breaker and for resisting inappropriate engagement of the trip plunger in response to a shock load, the shock-resistant solenoid assembly comprising:

a trip solenoid having a core movable along a tripping path between a retracted position and an extended position, in which the core in the extended position is engageable with the trip plunger;

an inertia lock having an inertia member operatively connected with a latch, the latch being disposed on a mount and being actuatable by the inertia member in response to the shock load to engage the core to restrain movement of the core to the extended position;

wherein said mount is substantially immovable with respect to the trip unit;

wherein said latch is movable between a rest position and an activated position, the latch in the activated position engaging the core, the latch being biased to the rest position by a first biasing device;

wherein said latch is pivotably mounted on the mount; and wherein said latch is pivotable about a pivot point, and wherein said inertia member and the latch together have a center of gravity that is spaced from the core, the pivot point being disposed between the center of gravity and the core.

2. A circuit breaker comprising:

a trip unit having a trip plunger;

a shock-resistant solenoid assembly for selectively engaging the trip plunger and for resisting inappropriate engagement of the trip plunger in response to a shock load, the shock-resistant solenoid assembly including a trip solenoid and an inertia lock;

the trip solenoid having a core movable along a tripping path between a retracted position and an extended position, in which the core in the extended position is engaged with the trip plunger;

the inertia lock having an inertia member operatively connected with a latch, the latch being disposed on a mount and being actuatable by the inertia member in response to the shock load to engage the core to restrain movement of the core to the extended position;

wherein said mount is substantially immovable with respect to the trip unit;

wherein said latch is movable between a rest position and an activated position, the latch in the activated position engaging the core, the latch being biased to the rest position by a first biasing device;

wherein said latch is pivotably mounted on the mount; and wherein said latch is pivotable about a pivot point, and wherein said inertia member and the latch together have a center of gravity that is spaced from the core, the pivot point being disposed between the center of gravity and the core.

* * * * *